US007748819B2

(12) United States Patent
Kimura

(10) Patent No.: US 7,748,819 B2
(45) Date of Patent: Jul. 6, 2010

(54) LIQUID STORAGE UNIT AND LIQUID EJECTING APPARATUS

(75) Inventor: Hitotoshi Kimura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/116,701

(22) Filed: May 7, 2008

(65) Prior Publication Data

US 2008/0211891 A1 Sep. 4, 2008

Related U.S. Application Data

(63) Continuation of application No. 10/782,467, filed on Feb. 19, 2004, now Pat. No. 7,472,804.

(30) Foreign Application Priority Data

Feb. 19, 2003 (JP) ..... 2003-040631
Feb. 18, 2004 (JP) ..... 2004-041812

(51) Int. Cl.
*B41J 2/165* (2006.01)

(52) U.S. Cl. ..... 347/25

(58) Field of Classification Search ..... 347/84, 347/85, 86

See application file for complete search history.

(56) References Cited

U.S. PATENT DOCUMENTS 4,119,034 A 10/1978 Wax
5,136,309 A 8/1992 Iida et al.
5,785,212 A * 7/1998 Steiger ..... 222/509
5,898,451 A 4/1999 Kaplinsky et al.
5,988,803 A 11/1999 Komplin et al.
6,145,970 A 11/2000 Sasaki et al.
6,224,199 B1 * 5/2001 Yamaguchi et al. ..... 347/85
6,243,115 B1 6/2001 Baker et al.
6,296,235 B1 * 10/2001 Dalal ..... 267/64.16

(Continued)

FOREIGN PATENT DOCUMENTS

CN 2402478 Y 10/2000

(Continued)

OTHER PUBLICATIONS

Search Report in corresponding European Patent Appln. No. 04 003 695.6, dated Mar. 23, 2005.

(Continued)

*Primary Examiner*—Stephen D Meier
*Assistant Examiner*—Alexander C Witkowski
(74) *Attorney, Agent, or Firm*—Stroock & Stroock & Lavan LLP

(57) ABSTRACT

The invention provides a liquid storage unit comprising: a case, a liquid storage part for storing a liquid in the case, with which a liquid port communicates; at least one gas accommodation part for accommodating a gas in the case, with which a gas port communicates, wherein the liquid in the liquid storage part is led out through the liquid port by a pressure of a gas introduced from the gas port; an inner case provided in the case having a pair of openings on opposite side faces thereof; and a pair of flexible partitioning members sealing said pair of openings of the inner case respectively, thereby partitioning the liquid storage part therebetween and defining said at least one of the gas accommodation part in cooperation with the case.

9 Claims, 5 Drawing Sheets

U.S. PATENT DOCUMENTS

| | | | | |
|---|---|---|---|---|
| 6,367,666 | B1 | 4/2002 | Hou et al. | |
| 7,152,965 | B2 | 12/2006 | Ishizawa et al. | |
| 2002/0036370 | A1 * | 3/2002 | Takaoka et al. | 267/140.11 |
| 2002/0180849 | A1 * | 12/2002 | Sakai et al. | 347/86 |

FOREIGN PATENT DOCUMENTS

| | | | |
|---|---|---|---|
| EP | 0 604 235 | A1 | 6/1994 |
| EP | 0 854 046 | A2 | 7/1998 |
| EP | 0 924 081 | A2 | 6/1999 |
| EP | 1 120 258 | A2 | 8/2001 |
| JP | 59-176540 | U | 11/1984 |
| JP | 59-209878 | | 11/1984 |
| JP | 61-277459 | | 12/1986 |
| JP | 01-133749 | A | 5/1989 |
| JP | 06-278286 | | 10/1994 |
| JP | 2001-212973 | | 8/2001 |

OTHER PUBLICATIONS

European Search Report dated Aug. 2, 2004, in European Patent Appln. No. 04 00 3695.

Complaint, *Seiko Epson Corp. et. al.* v. *Inkjetmadness.com, Inc., et. al.* (D. Or. Case No. 08-CV-452), Apr. 10, 2008.

Complaint, *Seiko Epson Corp. et. al.* v. *E-Babylon, Inc., et. al.* (D. Or. Case No. CV-07-0896-ST), Jun. 18, 2007.

Complaint for Patent Infringement, *Seiko Epson Corp., et al.* v. *E-Babylon, Inc., et al.*, CV-07-0896-ST (Jun. 18, 2007) (D. Or.).

Complaint for Patent Infringement, *Seiko Epson Corp., et al.* v. *Inkjetmadness.com, Inc., et al.*, CV-08-0452 (Apr. 10, 2008) (D. Or.).

* cited by examiner

LIQUID STORAGE UNIT AND LIQUID EJECTING APPARATUS

CROSS-REFERENCE TO RELATED APPLICATION

This application is a continuation of copending U.S. patent application Ser. No. 10/782,467, filed on Feb. 19, 2004, the entire contents of which are hereby incorporated by reference herein.

The present application is based on Japanese Patent Application Nos. 2003-40631 and 2004-041812, the entire contents of which are incorporated herein by reference.

BACKGROUND OF THE INVENTION

1. Field of the Invention

The present invention relates to liquid storage unit and a liquid ejecting apparatus mounting the liquid storage unit thereon.

2. Related Art

Conventionally, a liquid ejecting apparatus for injecting a droplet from the nozzle of a liquid ejection head includes an ink jet printer. Some ink jet printers include an ink supply system of an off carriage type for mounting an ink cartage in a place other than a carriage. The case in which the ink supply system of the off carriage type is provided includes the case in which an ink cartridge having a large capacity is provided for large printing and the case in which the ink cartridge is not mounted but the size of a carriage is reduced and the size and thickness of the ink jet printer is decreased.

In the ink supply system of the off carriage type, for example, the ink cartridge is provided on a body side. An ink is supplied from the ink cartridge to a subtank mounted on the carriage through a supply tube. On the other hand, there is a problem in that the dynamic pressure of the ink in the supply tube is raised because of an increase in the flow of the ink due to an increase in the speed and fineness of the printing of a printer, resulting in the insufficiency of the amount of the ink supplied to the subtank.

In order to solve the problem, there has been proposed an ink cartridge for accommodating a bag-shaped ink pack in the case of the ink cartridge and introducing air between the case and the ink pack, thereby pressurizing the ink pack to forcibly lead out an ink (for example, see JP-A-2001-212973).

In the ink cartridge for accommodating the bag-shaped ink pack in the case, however, it is necessary to raise an air pressure between the case and the ink pack. For this reason, the opening portion of the case for attaching the ink pack is to be sealed in an airtight state as shown in FIG. 10. In an ink cartridge 51, a plug member 55 sealing the opening portion of an ink pack 54 is protruded from an opening portion 53 formed on a case 52 toward an outside. In this state, an O-ring 56 is attached to the opening portion 53, and furthermore, an engaging member 57 is pushed in from the outside of the case 52. Consequently, the plug member 55 is fixed to the opening portion 53 in the airtight state.

In the ink cartridge for accommodating the bag-shaped ink pack in the case, accordingly, a seal member for enhancing a sealing property is required and the structure of the seal member is complicated. Accordingly a cost is increased or the size of an apparatus is increased in some cases.

To cope with the above problems, there have been proposed an ink cartridge (for example, JP S59-209878A) in which a bag member provided with a flexible film covers a recessed face of the cartridge body so that an ink is filled in a space formed between the bag member and the recessed face. A rigid lid having recess corresponding to the bag member filled with the ink is attached on the cartridge body. The bag member is pressurized by providing air between the bag member and the lid so that the ink is led out from the cartridge.

Since any ink pack is not housed, no sealing member for ink pack is provided in the cartridge. Therefore, such the ink cartridge can be provided with a simple structure in small size at low cost.

Meanwhile, even in the cartridge as disclosed in JP S59-209878A, it is important to keep sufficient deaeration degree of the ink for maintaining the quality of ink. However, in the ink cartridge of JP S59-209878A, the space in which the ink is filled is formed by the flexible film on one side face and the rigid main body on the other side faces. The main body of the cartridge is usually made of a plastic resin with a low gas barrier property. Therefore, even if only one side face is covered with the film with high gas barrier property, the total degree of deaeration of the ink filled in the space does not reach sufficiently high since a large portion of the surface of the space is defined by the main body Further, in JP S59-209878A, a space into which air is introduced is formed by fixing the rigid lid onto the rigid cartridge body. Accordingly, for fixing the lid onto the main body, it is necessary to use a simple manufacturing device and to avoid generation of foreign substances by operation as much as possible.

The invention relates to a liquid storage unit which is available by a simple manufacturing device, avoiding generation of foreign substances, and a liquid ejection apparatus in which the liquid storage unit is mounted.

SUMMARY OF THE INVENTION

The invention provides a liquid storage unit comprising:

a case;

a liquid storage part for storing a liquid in the case, with which a liquid port communicates;

at least one gas accommodation part for accommodating a gas in the case, with which a gas port communicates, wherein the liquid in the liquid storage part is led out through the liquid port by a pressure of a gas introduced from the gas port;

an inner case provided in the case having a pair of openings on opposite side faces thereof; and a pair of flexible partitioning members sealing said pair of openings of the inner case respectively, thereby partitioning the liquid storage part therebetween and defining said at least one of the gas accommodation part in cooperation with the case.

According to the liquid storage unit of the invention, the air accommodation part can be formed only by partitioning the inside of the case with a partitioning member. Among the faces with which the ink storage part is defined, two side faces are provided with the flexible partitioning members, and the other faces are provided with the inner case. By such the structure, the surface of the liquid storage part which is defined by the inner case made of a material with low gas barrier property can be small, whereas the surface which is defined by the partitioning members made of a material with high gas barrier property can be large for example. As a result high degree of deaeration can be obtained in the liquid storage part. Moreover, by providing two flexible partitioning members on the liquid storage part, even if the flexibility of the individual partitioning member is not so high, the total flexibility provided by both partitioning members for the liquid storage part can be high. As a result, remaining ink amount can be reduced by such the structure.

In the liquid storage unit according to the invention, the flexible partitioning member is provided with a flexible film, which is thermally welded to a welding portion at the opening of the inner case.

According to the above structure, among the faces with which the ink storage part is defined, two side faces are provided with the flexible films, and the other faces are provided with the inner case. By such the structure, the surface of the liquid storage part which is defined by the inner case made of a material with low gas barrier property can be small, whereas the surface which is defined by the flexible films made of a material with high gas barrier property can be large for example. As a result high degree of deaeration can be obtained in the liquid storage part. Moreover, by providing two flexible films on the liquid storage part, even if the flexibility of the individual film is not so high, the total flexibility provided by both films for the liquid storage part can be high. As a result, remaining ink amount can be reduced by such the structure.

In the liquid storage unit according to the invention, the flexible film has a laminate structure including at least a welding layer weldable to the welding portion and a gas barrier layer.

According to the above structure, it is possible to provide a liquid storage part accomplishing a higher degree of deaeration. Moreover, by providing two flexible films on the liquid storage part, even if the flexibility of the individual film is not so high, the total flexibility provided by both films for the liquid storage part can be high. As a result, the remaining ink amount can be reduced by such the structure.

In the liquid storage unit according to the invention, the case in which the inner case is provided has openings at a pair of side faces thereof corresponding to the openings of the inner case, and lids are sealed on the openings of the case respectively.

According to the above structure, by closing two openings with the lids, the liquid storage part is interposed between two air accommodation parts. Even if the remaining liquid in the liquid storage part becomes small, both of the flexible films can be flexed by introducing the air into both air accommodation parts. Therefore, even in a case that the remaining liquid in the liquid storage part is small, the liquid can be pressurized and ejected by flexion of both films.

The invention also provides a liquid storage unit comprising:

a case having an opening on a side face thereof;

a liquid storage part for storing a liquid in the case, with which a liquid port communicates;

at least one gas accommodation part for accommodating a gas in the case, with which a gas port communicates, wherein the liquid in the liquid storage part is led out through the liquid port by a pressure of a gas introduced from the gas port;

a first flexible partitioning member thermally welded to the case so as to define the liquid storage part in cooperation with the case;

a second flexible partitioning member sealing the opening of the case by thermal welding so as to define said at least one gas accommodation part in cooperation with the first partitioning member and the case.

According to the invention, by thermally welding the flexible film onto the opening of the case, few foreign substances are generated in thermal welding. Therefore, adherence of the foreign substance is not occurred. Moreover, the thermal welding can be performed easily compared to other welding methods. Therefore, the liquid storage unit having large capacity can be manufactured in an easy and simple manner.

In the liquid storage unit according to the invention, a protecting lid covering the second flexible partitioning member sealing the opening is provided in the case.

According to the above structure, the protecting lid covers the opening of the case. Therefore, breakage of the partitioning member can be prevented. Further, the portioning member forming the gas accommodation part by sealing the case also serves as a lid of the case. Therefore, it is not necessary to hermetically seal the protecting lid to the case, so that selection of material for the protecting lid is not restricted. Accordingly, the material for the protecting lid can be freely selected in a suitable manner in a case that importance is placed on the appearance of the cartridge.

The invention is also directed to a liquid ejecting apparatus comprising a liquid ejection head for discharging a liquid supplied from the liquid storage unit according to the invention, and a carriage for being reciprocated with the liquid ejection head mounted thereon.

According to the above structure, there is provided the liquid ejecting apparatus in which can the liquid can be supplied to the liquid ejecting head even if the liquid becomes small in the liquid storage unit in which the degree of deaeration is suitably maintain. Moreover, the total cost for manufacturing the liquid ejecting apparatus can be reduced by providing the liquid storage unit mounted in the apparatus to be a simple structure.

DETAILED DESCRIPTION OF THE PREFERRED EMBODIMENTS

First Embodiment

A first embodiment according to the invention will be described below with reference to FIGS. 1 to 5.

Figure 1:
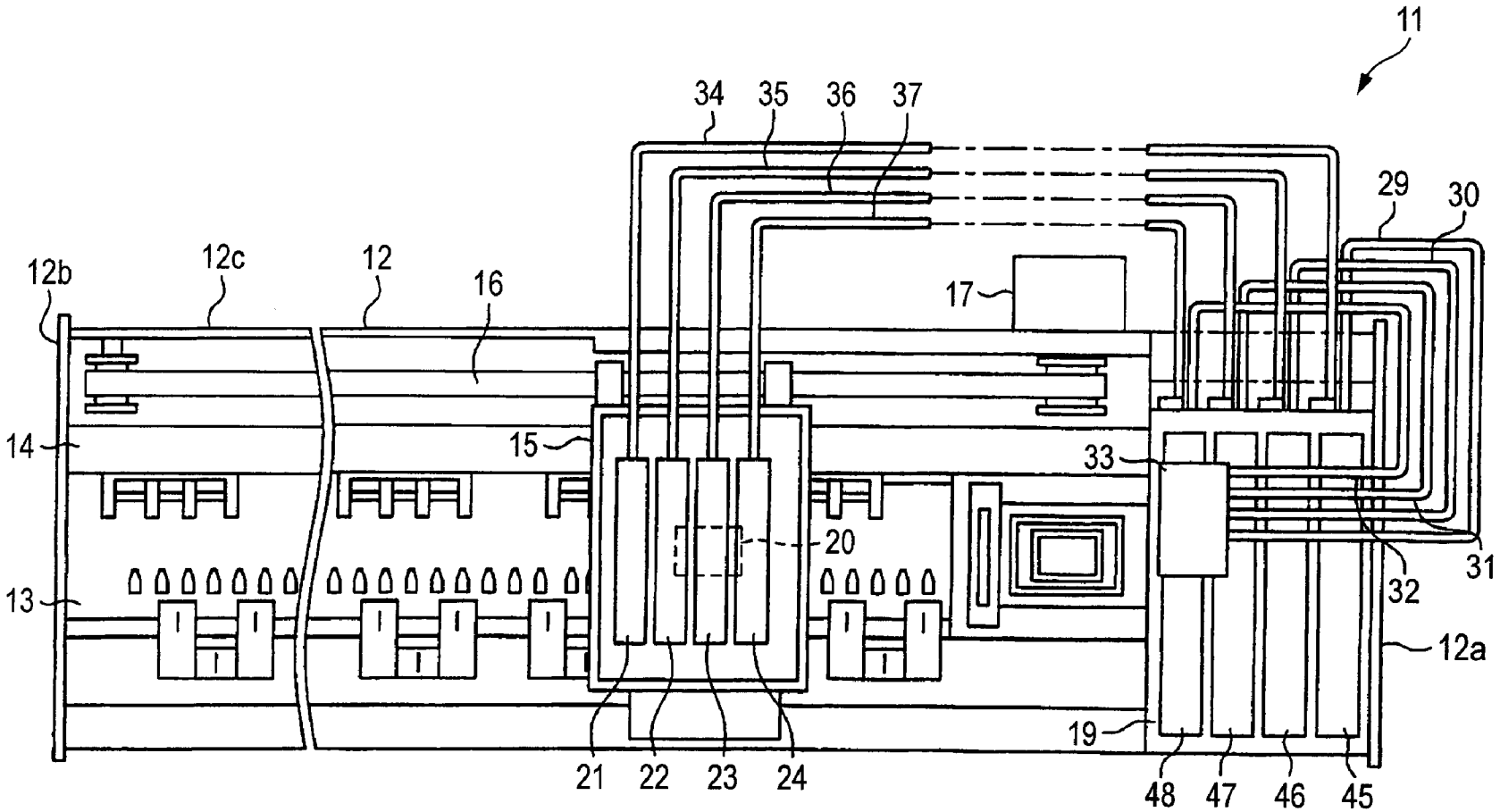
FIG. 1 is a plan view showing a printer body according to a first embodiment.

In an ink jet printer to be a liquid ejecting apparatus (which will be hereinafter referred to as a printer), a printer body 11 shown in FIG. 1 is provided in a case which is not shown. The printer body 11 comprises a frame 12 and a paper feeding member 13 provided in the frame 12. By a paper feeding mechanism which is not shown, a paper is delivered onto the paper feeding member 13. Moreover, a guide member 14 is provided in parallel with the paper feeding member 13 between a right side plate 12*a* and a left side plate 12*b* in the frame 12, and a carriage 15 is slidably supported on the guide member 14. The carriage 15 is connected to a carriage motor 17 provided on a back plate 12*c* of the frame 12 through a timing belt 16. The carriage 15 is reciprocated along the guide member 14 by the driving operation of the carriage motor 17.

Moreover, a recording head 20 to be a liquid ejection head is mounted on the surface of the carriage 15 which is opposed to the paper feeding member 13. Furthermore, subtanks 21 to 24 for supplying the recording head 20 with an ink to be a liquid are mounted on the carriage 15. In the embodiment, the four subtanks 21 to 24 are provided corresponding to inks for black, cyan, magenta and yellow.

A nozzle discharge port (not shown) is formed on the lower face of the recording head 20. By the driving operation of a piezoelectric unit which is not shown, the inks are discharged from respective corresponding nozzle discharge ports onto the paper so that printing is carried out.

On the other hand, the right end of the frame 12 is provided with a cartridge holder 19 for removably mounting ink cartridges 45 to 48 to be liquid storage unit. In the embodiment, the four ink cartridges 45 to 48 are provided in the cartridge holder 19 corresponding to the inks having the four colors. The ink cartridges 45 to 48 are connected to an air pump 33 through air supply tubes 29 to 32, and air to be a gas generated by the air pump 33 is supplied into the ink cartridges 45 to 48. By pressurization into the ink cartridges 45 to 48, the inks are supplied to the subtanks 21 to 24 through flexible ink supply tubes 34 to 37, respectively.

Figure 2:
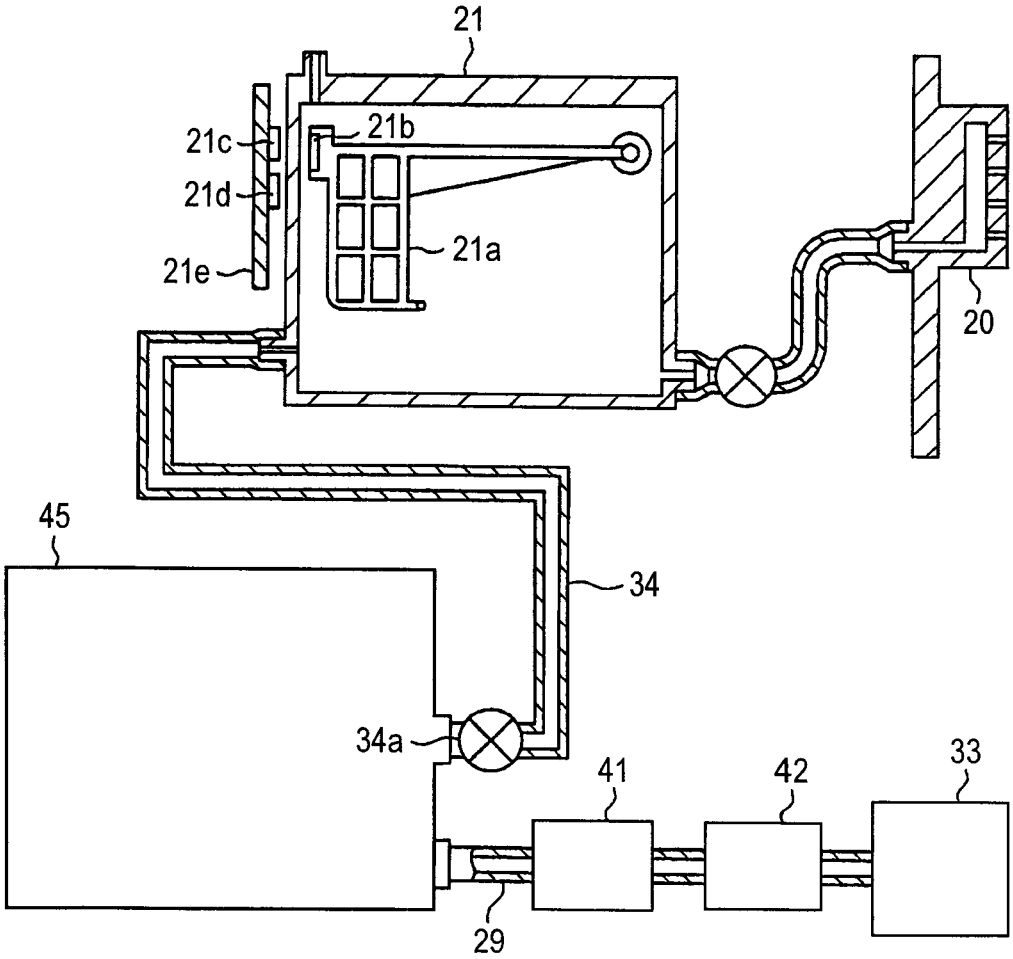
FIG. 2 is a typical view showing an ink supply system according to the first embodiment.

FIG. 2 is a typical view for explaining the structure of the ink supply system of the printer body 11. The ink cartridges 45 to 48, the air supply tubes 29 to 32 and the ink supply tubes 34 to 37 have the same structures, respectively. For convenience of explanation, description will be given to the ink supply system constituted by the ink cartridge 45 for supplying the ink to the subtank 21 and the description of the ink supply systems of the other ink cartridges 46 to 48 will be omitted.

The air generated by the air pump 33 is first supplied to a pressure regulating valve 42, and then, is supplied to the ink cartridge 45 through a pressure detector 41 and the air supply tube 29. The pressure regulating valve 42 has the function of releasing a pressure to set an air pressure to be applied to the ink cartridge 45 within a predetermined range when an air pressure raised by the air pump 33 reaches a predetermined value or more.

Moreover, the pressure detector 41 has the function of detecting the air pressure raised by the air pump 33, thereby controlling the driving operation of the air pump 33. More specifically, the pressure detector 41 stops the driving operation of the air pump 33 when detecting that the air pressure raised by the air pump 33 reaches a pressure having a predetermined value. The air pump 33 is controlled to be driven when the pressure detector 41 detects that the air pressure has the predetermined value or less. Thus, the pressure detector 41 has the function of repeating the driving operation of the air pump 33 and the stop of the driving operation, thereby maintaining the air pressure to be applied to the ink cartridge 45 within a predetermined range.

Figure 3:
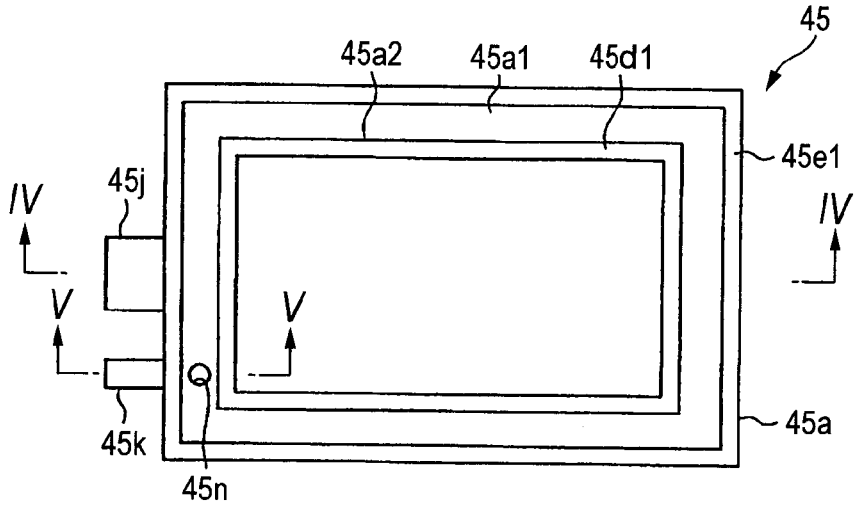
FIG. 3 is a plan view showing an ink cartridge according to the first embodiment.

The structure of the ink cartridge 45 will be described with reference to FIGS. 3 to 5. FIG. 3 is a plan view showing a case 45*a* of the ink cartridge 45 seen from above.

Figure 4:
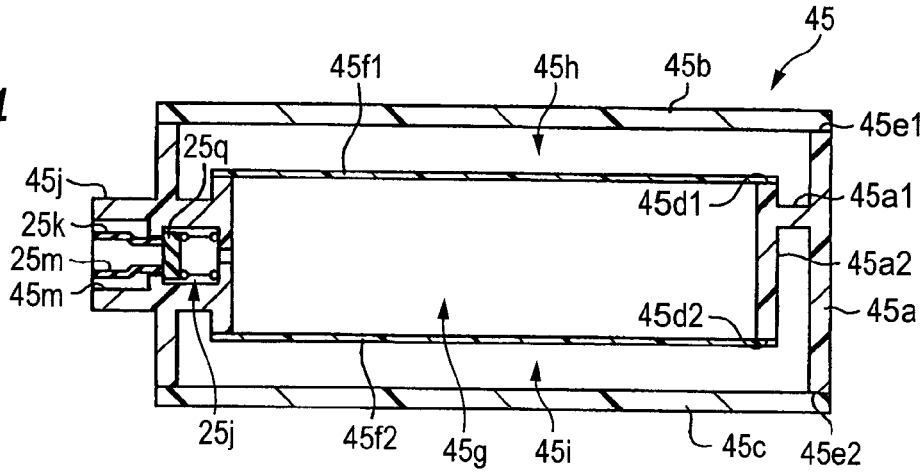
FIG. 4 is a sectional view showing the ink cartridge taken along an IV-IV line.
Figure 5:
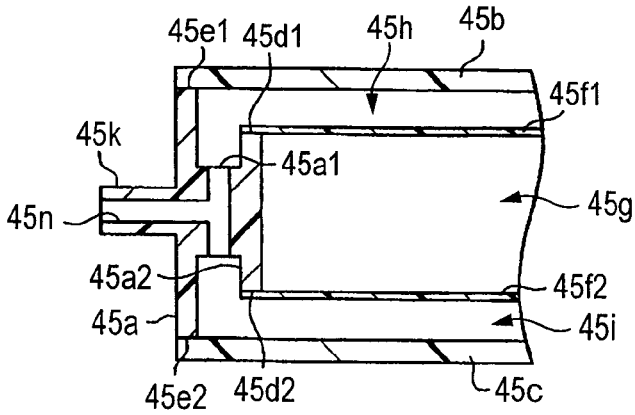
FIG. 5 is a sectional view showing the main parts off the ink cartridge taken along a V-V line.

FIGS. 4 and 5 are sectional views showing an ink cartridge 45 according to the embodiment, illustrating sections taken along IV-IV and V-V lines in FIG. 3 respectively, in which a case 45*a* is covered with lids 45*b*, 45*c*. The ink cartridge 45 comprises the case 45*a* taking the shape of a square frame in which upper and lower faces are opened. The case 45*a* is sealed by covering opening portions on both faces with lids 45*b* and 45*c*.

Lid welding portions 45*e*1, 45*e*2 for welding the lids 45*b* and 45*c* are formed on two faces of upper and lower faces in the case 45*a* formed of polypropylene or the like, respectively. An inner case 45*a*2 is integrally formed within the case 45*a* through a joint frame 45*a*1. The inner case 45*a*2 is formed with a square frame member having openings on two of the upper and lower faces on which film welding portions 45*d*1, 45*d*2 are formed respectively. Namely, the film welding portions 45*d*1, 45*d*2 are formed like square frames on the upper and lower faces. Lid welding portions 45*e*1, 45*e*2 are formed like square frames so as to surround the film welding portions 45*d*1, 45*d*2. Moreover, the lid welding portions 45*e*1, 45*e*2 are formed to be protruded from the film welding portions 45*d*1, 45*d*2. When two films 45*f*1, 45*f*2 to be flexible partitioning member are thermally welded to the film welding portions 45*d*1, 45*d*2 respectively, an ink chamber 45*g* to be liquid storage part is formed by the two films 45*f*1, 45*f*2 and the side faces of the inner case 45*a*2. Incidentally, each of the films 45*f*1, 45*f*2 is constituted by a lamination of polypropylene, a gas barrier layer and nylon or the like from a welding face side.

When the films 45*f*1, 45*f*2 are to be thermally welded to the film welding portions 45*d*1, 45*d*2, the case 45*a* is fixed by a fixing device (not shown) Then, a heater chip (not shown) is caused to descend from above in a state in which the films 45*f*1, 45*f*2 are mounted on the film welding portions 45*d*1, 45*d*2, and the films 45*f*1, 45*f*2 are thermally welded to the film welding portions 45*d*1, 45*d*2.

Further, the lids 45*b*, 45*c* formed by the same material as the material of the case 45*a* are vibrated and welded to lid welding portions 45*e*1, 45*e*2 in a state that the films 45*f*1, 45*f*2 have been welded to the film welding portions 45*d*1, 45*d*2. When the lids 45*b*, 45*c* are to be vibrated and welded to the lid welding portions 45*e*1, 45*e*2, the lids 45*b*, 45*c* abutting on the lid welding portions 45*e*1, 45*e*2 and the case 45*a* are interposed by two vibrating and welding devices (not shown), and a load is applied in a direction of a gravity by the driving operation of an actuator and they are driven to give a vibrating operation in a horizontal direction. By this operation, the lids 45*b*, 45*c* are slid with a load applied to the lid welding portions 45*e*1, 45*e*2. Accordingly, portions of the lids 45*b*, 45*c* which abut on the lid welding portions 45*e*1, 45*e*2 and the lid welding portions 45*e*1, 45*e*2 are molten respectively by frictional heat generated therebetween. The vibration in the horizontal direction in the vibrating and welding device is stopped while keeping the load so that the lids 45*b*, 45*c* are bonded to the lid welding portions 45*e*1, 45*e*2 in an airtight state.

As a result, a first air chamber 45*h* is formed above the ink chamber 45*g* by the lid 45*b*, the film 45*f*1 and the side faces of the case 45*a*. By the lid 45*c*, the film 45*f*2 and the side faces of the case 45*a*, a second air chamber 45*i* is formed below the ink chamber 45*g*. For this reason, the inside of the case 45*a* is partitioned into the ink chamber 45*g* and the two air chambers 45*h* and 45*i* by the two films 45*f*1, 45*f*2 and the ink chamber 45*g* is interposed between the air chambers 45*h* and 45*i*.

Moreover, a first connecting portion 45*j* for connecting the ink supply tube 34 and a second connecting portion 45*k* for connecting the air supply tube 29 are protruded from one of the side faces of the case 45*a*. An ink lead-out port 45*m* penetrates through the first connecting portion 45*j* as shown in FIG. 4, and an air introducing port 45*n* penetrates through the second connecting portion 45*k* as shown in FIG. 5. The ink lead-out port 45*m* is formed to lead the ink stored in the ink chamber 45*g* to an outside, and has a valve 25*j* and a seal-member 25*k* provided therein.

A hole 25*m* for a tube penetrates through the seal member 25*k*. The hole 25*m* for a tube is constituted by a large diameter portion for fitting and inserting a supply needle (not shown) which is connected to the ink supply tube 34 and a small diameter portion. The same small diameter portion is provided to abut on a valve member 25*q* constituting the valve 25*j*. When the supply needle connected to the ink supply tube 34 is inserted into the large diameter portion in this condition, the tip of the supply needle presses the valve member 25*q*. The valve member 25*q* is separated from the small diameter portion by pressing. Therefore, the ink is introduced from the ink chamber 45*g* into the ink lead-out port 45*m*.

As shown in FIG. 5, the air introducing port 45*n* penetrates through the second connecting portion 45*k*, and furthermore, branches at the joint frame 45*a*1 provided on the inner faces of the case 45*a* in a vertical direction in the drawing, and one is opened in the air chamber 45*h* and the other is opened in the air chamber 45*i*. When the amount of the ink in the subtank 21 is decreased, therefore, the air is introduced from an air pump 33 to the first and second air chambers 45*h* and 45*i* through an air supply tube 29. As a result, a pressure in each of the air chambers 45*h* and 45*i* is raised. By the pressure, each films 45*f*1, 45*f*2 are pressed and flexed toward the ink chamber 45*g*. Consequently, the ink in the ink chamber 45*g* is led out of the ink lead-out port 45*m*. Also in the case in which the amount of the residual ink is small, therefore, the ink can be led out.

The ink cartridge 45 having such a structure is provided in the printer body 11 in such a manner that the lids 45*b*, 45*c* are almost parallel with the right side plate 12*a* and the left side plate 12*b* in the frame 12 as shown in FIG. 1. The ink led out of the ink cartridge 45 is introduced into the subtank 21 through the ink supply tube 34 as shown in FIG. 2. The ink supply tube 34 has an ink supply valve 34*a* provided in the middle thereof. The ink supply valve 34*a* is opened or closed so that the supply of the ink to the subtank 21 is controlled.

The subtank 21 has a float member 21*a* provided therein, and a permanent magnet 21*b* is attached to one of the ends of the float member 21*a*. Magnetoelectric converting units 21*c* and 21*d* formed by Hall elements or the like attached to a substrate 21*e* and is provided on the side wall of the subtank 21. By this structure, an electrical output is generated by the magnetoelectric converting units 21*c* and 21*d* corresponding to the amount of a line of magnetic force obtained by the permanent magnet 21*b* which is changed depending on the floating position of the float member 21*a*. For example, in the case in which the amount of the ink in the subtank 21 is decreased, the position of the float member 21*a* is moved downward in the direction of a gravity so that the position of the permanent magnet 21*b* is also moved downward. For this reason, the electrical outputs of the magnetoelectric converting units 21*c* and 21*d* can be sensed as the amount of the ink in the subtank 21. If it is sensed that the amount of the ink is small, the ink supply valve 34*a* is opened.

Consequently, the ink pressurized in the ink cartridge 45 is led to the subtank 21 in which the amount of the ink is reduced. In the case in which the amount of the ink in the subtank 21 reaches a predetermined capacity, the ink supply valve 34*a* is closed based on the electrical outputs of the magnetoelectric converting units 21*c* and 21*d*. By the repetition of the opening and closing operations of the ink supply valve 34*a*, the ink is supplied into the subtank 21 and the almost constant ink is always stored in the subtank 21.

According to the first embodiment, the following advantages can be obtained.

(1) In the first embodiment, the inner case 45*a*2 off the case 45*a* covered with the lids 45*b*, 45*c* is partitioned by the films 45*f*1, 45*f*2, thereby forming the ink chamber 45*g* and the first and second air chambers 45*h*, 45*i*. Therefore, it is not necessary to constitute the ink chamber 45*g* by the bag-shaped ink pack. Accordingly, the ink chamber 45*g* can simply be constituted and a cost in the manufacture and assembly of the ink cartridge 45 can be reduced.

Moreover, the air introducing port 45*n* and the ink lead-out port 45*m* are directly formed on the case 45*a*. Consequently, the air can be directly introduced from the ink introducing port 45*n* into the first and second air chambers 45*h*, 45*i* and the ink in the ink chamber 45*g* can be directly led out of the ink lead-out port 45*m* formed on the case 45*a*. Accordingly, it is not necessary to connect the case 45*a* to the first and second air chambers 45*h*, 45*i* and ink chamber 45*g*. The seal member for connection is not required. For this reason, the ink cartridge 45 can have a simple structure. Therefore, it is possible to prevent an increase in a cost and an increase in the size of the apparatus.

(2) In the first embodiment, the case 45*a* is partitioned by the films 45*f*1, 45*f*2, thereby forming the ink chamber 45*g* and the first and second air chambers 45*h*, 45*i*. The air generated by the air pump 33 is introduced into the first and second air chambers 45*h*, 45*i*. Accordingly, the flexible films 45*f*1, 45*f*2 are flexed by the pressurized air so that the ink in the ink chamber 45*g* can be pressurized. Also in the case in which the amount of the ink in the ink chamber 45*g* is small, therefore, the ink can be led out.

(3) In the first embodiment, among six side faces forming the ink chamber 45*g*, the upper and lower side faces which have large surface area are formed with the film 45*f*1, 45*f*2, and the other four side faces are formed with the case 45*a* (more specifically, the inner case 45*a*2) That is, the area forming the ink chamber 45*g* with the case 45*a* (inner case 45*a*2) made of plastic resin with low gas barrier property is lowered as much as possible, so that the area forming the ink chamber 45*g* with the films 45*f*1, 45*f*2 with high gas barrier property becomes large. Therefore, the ink chamber 45*g* with high degree of deaeration is formed.

In particular, in the embodiment, each of the films 45*f*1, 45*f*2 is constituted by laminating polypropylene, gas barrier layer, nylon and the like. The outer layer is made of polypropylene as a material weldable to the film welding portions 45*d*1, 45*d*2. The high gas barrier property can be secured by using films containing a layer of metal such as aluminum which yields good performance as the gas barrier layer. Nylon is formed on the gas barrier layer for protection.

(4) In the first embodiment, the inside of the case 45*a* is partitioned into the ink chamber 45*g* and the first and air chambers 45*h* and 45*i* by the two films 45*f*1, 45*f*2, and the ink chamber 45*g* is interposed between the two air chambers 45*h* and 45*i*. Also in the case in which the amount of the ink in the ink chamber 45*g* is decreased, therefore, the air can be introduced into each of the air chambers 45*h* and 45*i* to flex each film 45*f*1, 45*f*2. Also in the case in which the amount of the ink in the ink chamber 45*g* is small, accordingly, it is possible to flex the films 45*f*1, 45*f*2, thereby pressurizing the ink in the ink chamber 45*g* to lead out the ink. Particularly, in a case that films 45*f*1, 45*f*2 with high gas barrier property, which are generally less flexible than other films for the partitioning member, are used, the total flex amount of the ink chamber 45*g* can be obtained sufficiently large by providing the films on both of upper and lower face, thereby reducing the residual ink. Therefore, the remaining ink which is not utilized can be reduced while keeping degree of deaeration.

(5) In the first embodiment, each film 45*f*1, 45*f*2 is thermally welded to each film welding portion 45*d*1, 45*d*2, and the lids 45*b* and 45*c* are vibrated and welded to the lid welding portions 45*e*1, 45*e*2 protruded from the film welding portions 45*d*1, 45*d*2. For this reason, the sealing properties of the ink chamber 45*g* and each off the air chambers 45*h* and 45*i* can be enhanced, and furthermore, the air chambers 45*h* and 45*i* can be provided on both sides of the ink chamber 45*g* with a simple structure.

(6) In the first embodiment, the first connecting portion 45*j* and the second connecting portion 45*k* are formed on one of the side faces of the case 45*a*, and the ink lead-out port 45*m* and the air introducing port 45*n* penetrate, respectively. Therefore, it is also possible to cope with the case in which the ink is led out or the air is introduced from the side face of the ink cartridge 45 provided in the printer body 11.

Second Embodiment

Next, a second embodiment according to the invention will be described with reference to FIG. 6. In the second embodiment, the structure of the ink cartridge according to the first embodiment is only changed. Therefore, the detailed description of the same portions will be omitted.

Figure 6:
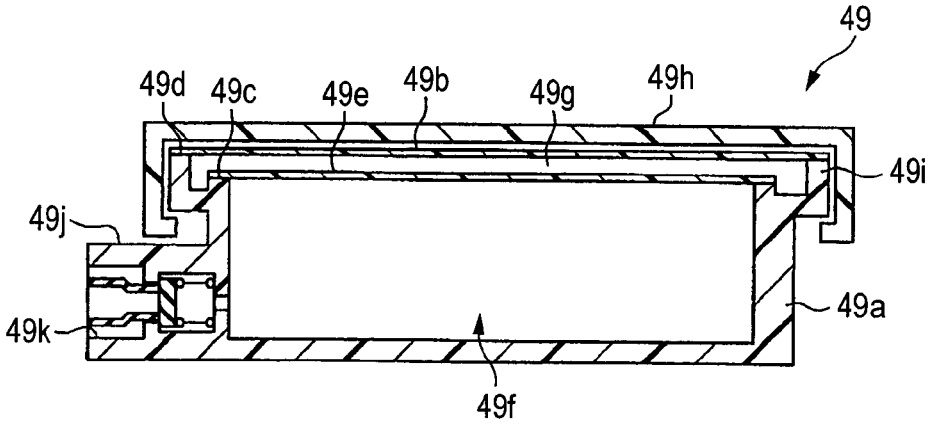
FIG. 6 is a plan view showing an ink cartridge according to a second embodiment.

FIG. 6 is a sectional view showing an ink cartridge 49 taken along an IV-IV line in FIG. 3, illustrating the case in which covering with an outer film 49*b* and a protecting lid 49*h* is carried out. The ink cartridge 49 includes a case 49*a* taking the shape of a rectangular parallelepiped in which an upper face is opened.

A film welding portion 49*c* and a lid welding portion 49*d* are protruded from the case 49*a* formed of polypropylene. The welding portion 49*c* is formed like a square frame, and the lid welding portion 49*d* is formed like a square frame in order to surround the film welding portion 49*c*. Furthermore, the lid welding portion 49*d* is formed to be higher than the film welding portion 49*c*.

When an inner film 49*e* is thermally welded to the film welding portion 49*c*, an ink chamber 49*f* to be an ink storage part is formed by the inner film 49*e* and the bottom and side faces of the case 49*a*. When an outer film 49*b* to be a lid member is thermally welded to the lid welding portion 49*d* in a state in which the inner film 49*e* is welded to the film welding portion 49*c*, furthermore, an air chamber 49*g* is formed above the ink chamber 49*f* by the outer film 49*b*, the inner film 49*e* and the side face of the case 49*a*. Accordingly, the ink chamber 49*f* and the air chamber 49*g* are formed by thermally welding the inner film 49*e* and the outer film 49*b* in the same manner. Consequently, a step of assembling the ink cartridge 49 can be prevented from being complicated.

After the outer film 49*b* is welded to the lid welding portion 49*d*, the upper face of the case 49*a* is covered with the protecting lid 49*h*. The protecting lid 49*h* is formed by a synthetic resin and has a bottom, and is formed in such a manner that the end of a side face is bent inward. The bent end can be sealed with a protruded portion 49*i* protruded horizontally from the case 49*a* under the lid welding portion 49*d*. For this reason, the protecting lid 49*h* can be prevented from slipping from the case 49*a*.

According to the second embodiment, it is possible to obtain the following advantages in addition to the same advantages as those of the (1), (2) and (6) described in the first embodiment.

(7) In the second embodiment, the outer film 49*b* is thermally welded to the lid welding portion 49*d* in a state in which the inner film 49*e* is welded to the film welding portion 49*c*. Accordingly, the ink chamber 49*f* and the air chamber 49*g* are formed by thermally welding the inner film 49*e* and the outer film 49*b* in the same manner. Therefore, a step of assembling the ink cartridge 49 can be prevented from being complicated.

(8) Further, in the second embodiment, the thermal welding does not yield any chips as in vibration welding and there is no fear that foreign substances are adhered on the welding portions. Moreover, the thermal welding to the welding portions of the case 49*a* having large openings is relatively easy as compared to the vibration welding. Therefore, the ink cartridge 49 having large capacity can be manufactured in an easy and simple manner.

(9) In the second embodiment, the outer film 49*b* is welded to the lid welding portion 49*d* and the upper face of the case 49*a* is then covered with the protecting lid 49*h*. Consequently, the outer film 49*b* can be prevented from being broken.

In the second embodiment, the film 49*b* also serves as a lid of the case 49*a* by sealing the case 49*a* to form the air chamber 49*g*. Therefore, there is no need to weld the protecting lid 49*h* to the case 49*a* by vibration welding or the like, and selection of material for the protecting lid 49*h* is not restricted. Accordingly, the material for the protecting lid 49*h* can be freely selected in a suitable manner in a case that importance is placed on the appearance of the ink cartridge 49.

Third Embodiment

Figure 8:
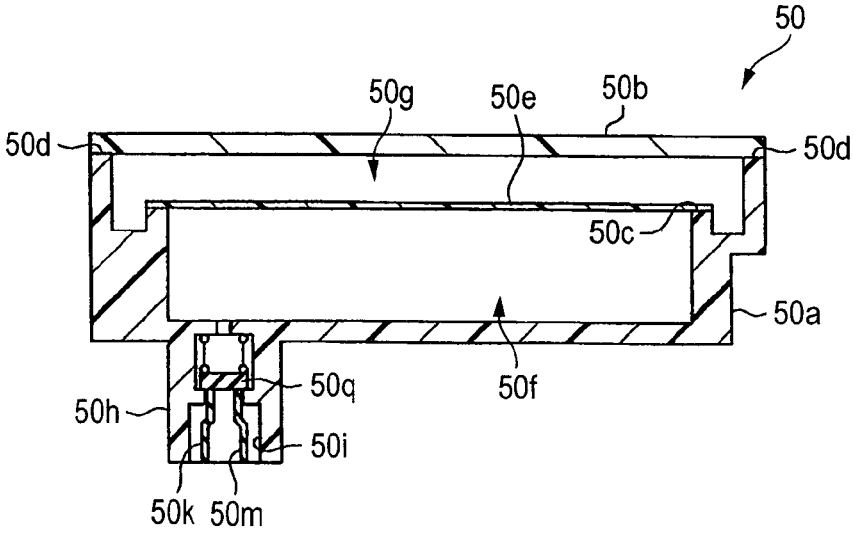
FIG. 8 is a sectional view showing the ink cartridge taken along a VIII-VIII line.
Figure 9:
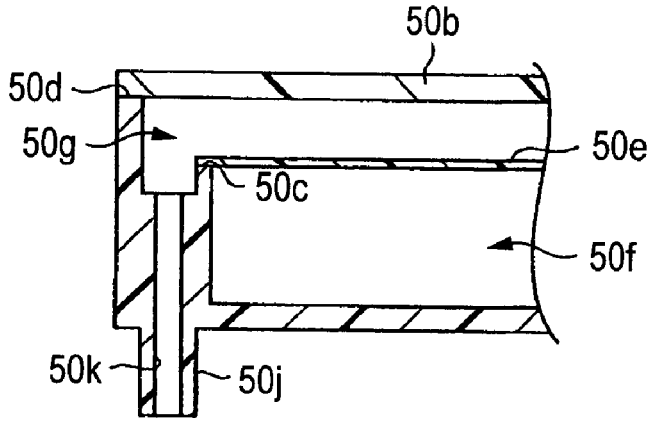
FIG. 9 is a sectional view showing the ink cartridge taken along an IX-IX line.
Figure 10:
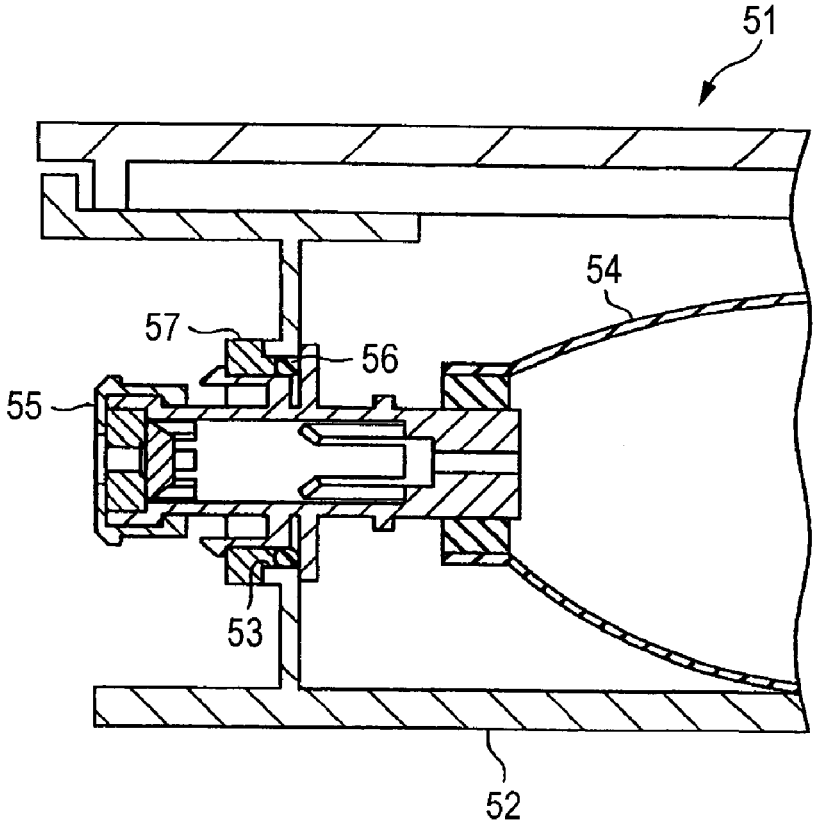
FIG. 10 is a sectional view showing the main parts of a conventional ink cartridge.

Next, a third embodiment according to the invention will be described with reference to FIGS. 7 to 9. The third embodiment is directed to a connecting portion of the cartridge. Therefore, the detailed description of the same portions will be omitted.

Figure 7:
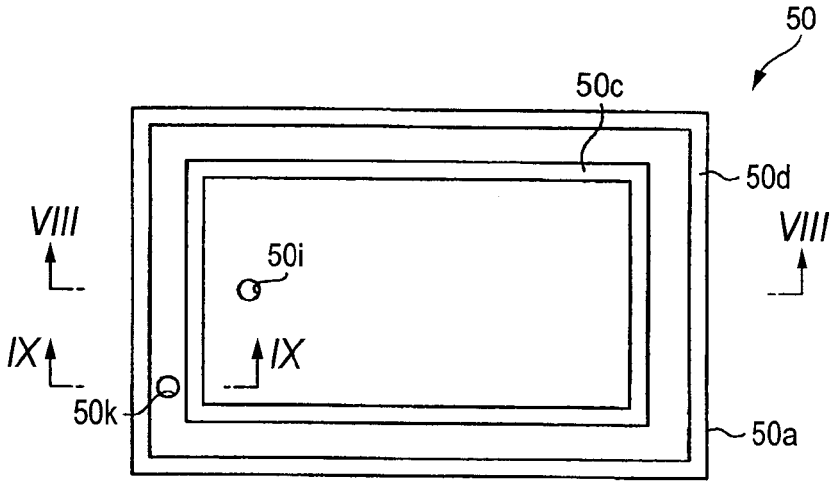
FIG. 7 is a plan view showing an ink cartridge according to a third embodiment.

FIG. 7 is a plan view showing an ink cartridge 50 according to the embodiment as seen from above. FIG. 8 is a sectional view showing the ink cartridge 50 taken along a VIII-VIII line in FIG. 7, and FIG. 9 is a sectional view showing the ink cartridge 50 taken along an IX-IX line in FIG. 7. FIGS. 8 and 9 show the case in which a case 50*a* is covered with a lid 50*b*. The ink cartridge 50 includes a case 50*a* taking the shape of a rectangular parallelepiped which has an upper face opened, and the case 50*a* is sealed by covering the opening portion with the lid 50*b*.

A film welding portion 50*c* and a lid welding portion 50*d* are protruded from the case 50*a* formed of polypropylene. The film welding portion 50*c* is formed like a square frame, and the lid welding portion 50*d* is formed like a square frame in order to surround the film welding portion 50*c*. Furthermore, the lid welding portion 50*d* is formed to be higher than the film welding portion 50*c*.

On the other hand, when a film 50*e* is thermally welded to the film welding portion 50*c*, an ink chamber 50*f* is formed by the film 50*e* and the bottom and side faces of the case 50*a*. When the lid 50*b* formed by the same material as the material of the case 50*a* is vibrated and welded to the lid welding portion 50*d*, moreover, an air chamber 50*g* is formed by the lid 50*b*, the side face of the case 50*a* and the film 50*e*. Moreover, a first connecting portion 50*h* for fitting and inserting a supply needle connected to an ink supply tube 34 is protruded from the bottom face of the case 50*a*. An ink lead-out port 50*i* communicating with the ink chamber 50*f* penetrates through the first connecting portion 50*h* and the bottom face of the case 50*a* on which the first connecting portion 50*h* is formed.

Moreover, a second connecting portion 50*j* for connecting an air supply tube 29 is formed on the bottom face on which the first connecting portion 50*h* is formed. As shown in FIG. 9, an air introducing port 50*k* communicating with the air chamber 50*g* penetrates through the second connecting portion 50*j* and a side face on which the second connecting portion 50*j* is formed. The air introducing port 50*k* is constituted by a hole penetrating toward the air chamber 50*g* in a vertical direction in the drawing, and supplies the pressurized air fed from an air pump 33 to the air chamber 50*g* formed above the ink chamber 50*f*.

In the ink lead-out port 50*i* and the air introducing port 50*k*, thus, the first connecting portion 50*h* and the second connecting portion 50*j* are formed on the bottom face of the case 50*a*, and can be therefore opened on the bottom face of the case 50*a*. Consequently, it is also possible to cope with the case in which an ink or the air fed from the air pump 33 is to be led out of or introduced into the bottom face of the case 50*a*. Moreover, the ink cartridge 50 can be provided in such a manner that the bottom face of the case 50*a* is almost parallel with a right side plate 12*a* and a left side plate 12*b* in a frame 12. In addition, the bottom face of the case 50*a* can be provided to be a lower face.

According to the third embodiment, it is possible to obtain the following advantages in addition to the same advantages as those of the (1) and (2) described in the first embodiment.

(11) In the third embodiment, the first connecting portion 50*h* and the second connecting portion 50*j* are formed on the bottom face of the case 50*a*, and the ink lead-out port 50*i* and the air introducing port 50*k* penetrate and are opened at the bottom face of the case 50*a*, respectively. Consequently, the ink cartridge 50 can be caused to cope with the case in which the air is to be introduced into or the ink is to be led out of the bottom face of the case 50*a* corresponding to a position in which the ink cartridge 50 is provided and a position of the air pump 33. Accordingly, it is possible to enhance the degree of freedom of the design of the printer body Each of the embodiments may be changed as follows.

While the four ink cartridges 45 to 48 are provided in each of the embodiments, the number of the ink cartridges mounted on the printer body 11 may be optional.

In each of the embodiments, the bottom face of the case and the lid in the ink cartridges 45 to 48 are provided in the printer body 11 in almost parallel with the right side plate 12*a* and the left side plate 12*b* in the frame 12. In addition, the ink cartridges 45 to 48 may be provided in any direction, for example, the bottom face of the case is provided to be a lower face.

In the embodiments, the films 45*f*1, 45*f*2 and 50*e* or the inner film 49*e* may be thermally welded so as to partition the case in a loose state as in the second embodiment. Thus, the films 45*f*1, 45*f*2 and 50*e* or the inner film 49*e* can be flexed to pressurize the ink even if the amount of the ink is very small. Moreover, the bottom or side faces of the ink chambers 45*g*, 49*f* and 50*f* may be curved so as to coincide with the shape of the flexed film. Thus, the ink can be prevented from remaining in the corner portions of the ink chambers 45*g*, 49*f* and 50*f*. Consequently, the lead-out property of the ink can be enhanced more greatly.

In the first, and third embodiments, the lids 45*b*, 45*c* and 50*b* may be constituted by a film as shown in the second embodiment, and furthermore, may be covered with a protecting lid as in the fourth embodiment. Thus, a step of assembling the ink cartridges 45 and 50 can be prevented from being complicated.

In the second embodiment, the first connecting portion 49*j* may be formed on the bottom faces of the cases as in the third embodiment. Thus, the ink lead-out port 49*k* or the air introducing port (not shown) can be opened at the bottom face. Consequently, it is possible to enhance the degree of freedom of the design of the printer body 11.

While the films 45*f*1, 45*f*2 are constituted by laminating polypropylene, gas barrier layer, nylon and the like in the above embodiments, the film may be formed with a two-layer structure in a case that a gas barrier layer is provided with a material inactive to environment. For example, a film having two-layer structure constituted by propylene as welding layer and EVOH resin (ethylene-vinyl alcohol copolymer) as gas barrier layer may be served as the flexible films of the invention.

While the liquid ejecting apparatus is used in the ink jet printer in each of the embodiments, it may be applied to a liquid ejecting apparatus for injecting a liquid other than an ink. For example, it is also possible to employ a liquid ejecting apparatus for injecting a liquid such as an electrode material or a coloring material to be used in the manufacture of a liquid crystal display, an EL display or an FED (face emitting display), a liquid ejecting apparatus for injecting a biological organic matter to be used in the manufacture of a biochip, and a sample injecting apparatus to be a precision pipette.

What is claimed is:

1. A liquid storage unit comprising:

a case;

a liquid chamber provided in the case and storing liquid;

a gas chamber provided in the case and accommodating gas;

a liquid port communicating with the liquid chamber and configured to lead out the liquid therefrom;

a gas port communicating with the gas chamber and configured to introduce gas into the gas chamber;

an inner frame portion provided in the case;

an outer frame portion provided in the case and surrounding the inner frame portion, the outer frame portion being higher than the inner frame portion;

an inner film thermally welded to the inner frame portion; and an outer film thermally welded to the outer frame portion, wherein the liquid chamber is defined by at least the inner film and the case; and wherein the gas chamber is defined by at least the outer film, the inner film and the case.

2. The liquid storage unit according to claim 1, further comprising a protecting lid covering the outer film and provided in the case.

3. The liquid storage unit according to claim 1, wherein the case has a rectangular parallelepiped shape in which an upper face is opened.

4. The liquid storage unit according to claim 1, wherein the inner film has a laminate structure including at least a welding layer formed with a material weldable to the inner frame portion and a gas barrier layer.

5. A manufacturing method of a liquid storage unit comprising:

providing a case with a synthetic resin having a liquid port, a gas port, an inner frame portion and an outer frame portion being higher than the inner frame portion and surrounding the inner frame portion;

thermally welding an inner film to the inner frame portion, so that a liquid chamber for storing liquid and communicated with the liquid port is formed by at least the inner film and the case; and thermally welding an outer film to the outer frame portion in a state that the inner film is welded to the inner frame portion, so that a gas chamber for accommodating gas and communicated with the gas port is defined by at least the outer film, the inner film and the case, wherein the liquid port is configured to lead out the liquid from the liquid chamber, and the gas port is configured to introduce gas into the gas chamber.

6. The manufacturing method of a liquid storage unit according to claim 5, further comprising providing a protecting lid so as to cover the outer film.

7. A liquid storage unit, comprising:

a case, formed with an opening;

a liquid storage part, provided in the case and storing liquid;

a gas accommodation part, provided in an outside of the liquid storage part within the case and accommodating gas, the gas accommodation part being fluidly isolated from the liquid storage part;

a liquid port, communicating with the liquid storage part;

a gas port, communicating with the gas accommodation part;

a flexible, first partitioning member, thermally welded to the case; and a flexible, second partitioning member, thermally welded to the case so as to close the opening, wherein:

the liquid storage part is defined by the case and the first partitioning member;

the gas accommodating part is defined by the case, the first partitioning member and the second partitioning member; and the liquid storage part is configured such that the liquid stored in the liquid storage part is led out from the liquid port by pressure of gas introduced from the gas port.

8. A liquid storage unit, comprising:

a case, formed with an opening;

a liquid storage part, provided in the case and storing liquid;

a gas accommodation part, provided in the case and accommodating gas, and fluidly isolated from the liquid storage part;

a liquid port, communicating with the liquid storage part;

a gas port, communicating with the gas accommodation part;

a flexible, first partitioning member, thermally welded to the case; and a second partitioning member, thermally welded to the case so as to close the opening, wherein:

the liquid storage part is defined by the case and the first partitioning member;

the gas accommodating part is defined by the case, the first partitioning member and the second partitioning member; and the liquid storage part is configured such that the liquid stored in the liquid storage part is led out from the liquid port by pressure of gas introduced from the gas port.

9. The liquid storage unit according to claim 8, wherein the second partitioning member is flexible.

* * * * *